United States Patent [19]

Anthony

[11] 4,101,123

[45] Jul. 18, 1978

[54] JUMP ROPE

[76] Inventor: Timothy M. Anthony, 143-40 Roosevelt Ave., New York, N.Y. 11354

[21] Appl. No.: 776,838

[22] Filed: Mar. 14, 1977

[51] Int. Cl.[2] ..... A63B 5/20

[52] U.S. Cl. ..... 272/75

[58] Field of Search ..... 272/74, 75

[56] References Cited

U.S. PATENT DOCUMENTS 3,363,898 1/1968 Crovello ..... 272/75

FOREIGN PATENT DOCUMENTS 6,467 of 1909 United Kingdom ..... 272/75

*Primary Examiner*—Richard C. Pinkham
*Assistant Examiner*—Arnold W. Kramer
*Attorney, Agent, or Firm*—Wolder, Gross & Yavner

[57] ABSTRACT

A jump rope including a connection between rope and handle having a ball bearing assembly. The ball bearing assembly includes the balls and race taught by the prior art and a housing having an outer flange and an inner shoulder defining therebetween a handle recess. The handle includes a handle connecting flange for fitting into the recess and is formed of and features resilient material to enable easy attachment and detachment. The rope fits through a ball bearing opening defined through the center of the ball bearing assembly and is held by rope connecting means to the assembly.

1 Claim, 3 Drawing Figures

JUMP ROPE

This invention relates primarily to jump ropes and more particularly to jump ropes using a ball bearing assembly for connection of the rope to the handle.

The structure of jump ropes has improved over the years from its beginning models, which featured a simple rope. More sophisticated structures were then provided wherein a simple handle was tied or otherwise crudely attached to each end of the rope. More recently, jump rope manufacturers have advertised and sold a more sophisticated construction, wherein large wooden handles were staked by a metal plate, which defined a central opening through which a rope was held by a ball bearing assembly which fitted into an appropriate recess in the wooden handle. Such prior art constructions suffered from the drawback of crude construction with respect to the earlier models. Such early structures had decreased play value due to the tendency of the rope to twist during use because of the commonly affixed connection between the rope and the handle.

As to the later constructions, the opposite was true. The structures were entirely too expensive and sophisticated for the intended use. Its disassembly for repair or replacement purposes was impossible due to the particular connections used between the rope and the handle.

Accordingly, a primary object of the present invention to provide a jump rope combining means for preventing twisting of the rope and inexpensive, yet functional means, for providing an item for increased play value.

Another object of the present invention is to provide a jump rope which is inexpensive and yet functional in combining the fixtures of simplicity and ball bearing mounting of the rope, which enables easy replacement and/or repair of the parts of the jump rope.

These and other objects of the present invention are provided in a jump rope construction which features a handle of cylindrical shape and including a closed end and an open end. The open end of the handle terminates in a handle connecting flange and the handle is formed of a flexible, yet resilient material such as many of the common plastics presently available. A ball bearing assembly defines at its center a rope opening through which the rope extends and is held by a wire stop element or a washer stop element or both. The ball bearing assembly includes the usual race and balls rotatably encased within a ball bearing housing. The ball bearing housing defines an outer, generally cylindrical attachment face, which includes an outer flange and an inner shoulder defining therebetween a handle recess into which the handle connecting flange fits.

Other objects, features and advantages of the present invention will become more apparent by reference to the following more detailed description of a preferred, yet illustrative, embodiment of the present invention and the accompanying drawings, wherein.

Figure 1:
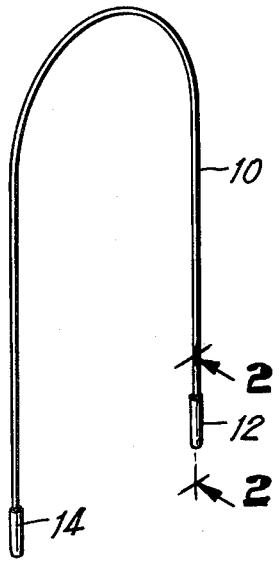
FIG. 1 is a pictorial view of a jump rope according to the present invention showing a rope extending between two handles.

Referring to the drawings FIG. 1 shows a rope 10 extending between handles 12 and 14. Typical use of the present invention is accomplished by grasping the handles 12 and 14, one in each hand, and making windmill circular motions so that the arms of the user rotate in parallel planes perpendicular to the ground. As stated previously with a fixed connection between rope and handles of the prior art, the rope will tend to twist during use. By means of the present invention, such use will not result in twisting of the rope, but instead will provide a smoothly rotating rope relative to the handles and an assembly enabling easy detachment between rope and handles for purposes of repair or replacement or convenient storage of the item.

Figure 2:
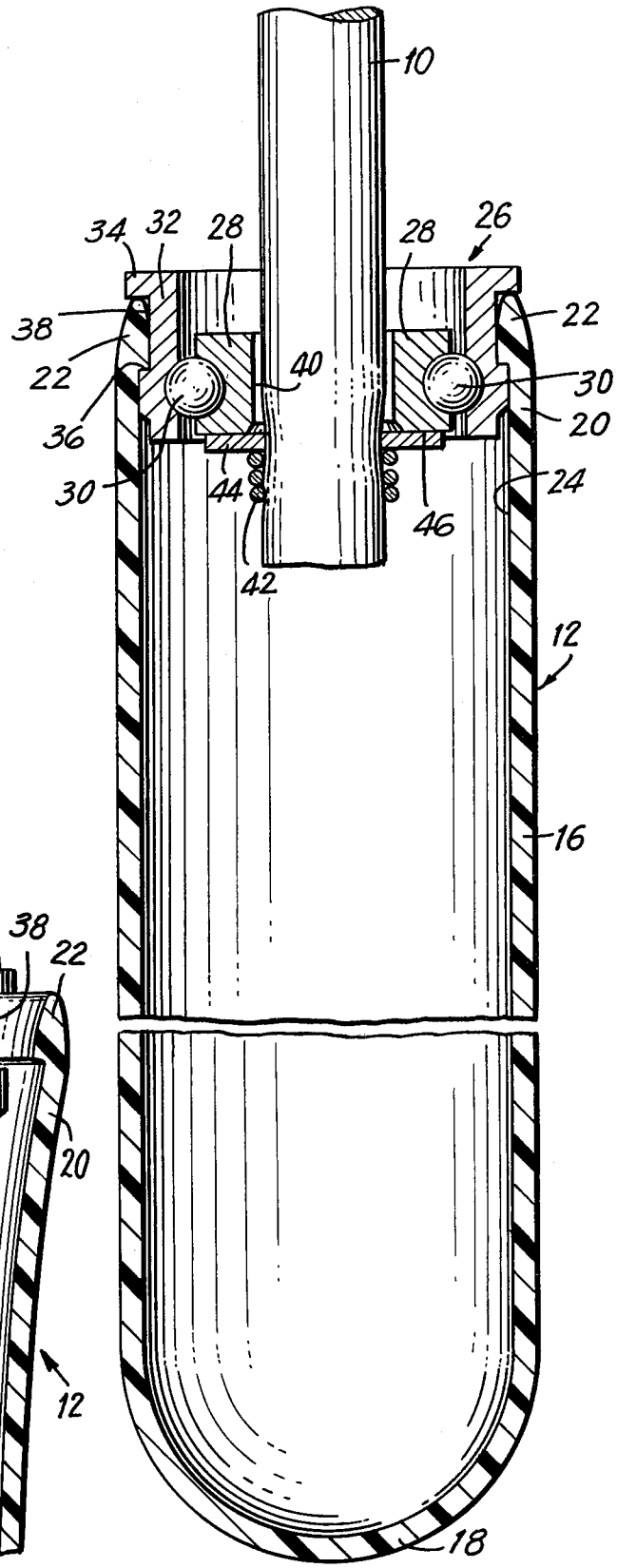
FIG. 2 is a sectional view taken along the line 2—2 of FIG. 1 and showing particularly the connection between the handle and the rope by means of a ball bearing assembly and a structure according to the present invention; and, FIG. 3 is a sectional view similar to that of FIG. 2, but showing particularly the rope and ball bearing assembly being detached from the handle.

Referring to FIG. 2, handle 12 is shown to include a cylindrical body 16 having a closed end 18 and an open end 20. Open end 20 terminates in a handle connecting flange 22 which extends slighly into a handle recess 24 for attachment purposes as will be hereinafter explained.

Fitting within the open end 20 of handle recess 24 is a ball bearing assembly generally designated 26. Ball bearing assembly includes the commonly provided inner race element 28 and balls 30 of the prior art. Ball bearing housing 32 forms the outer race and defines an outer face of generally circular shape which includes outer flange 34 and inner shoulder 36. Defined between outer flange 34 and inner shoulder 36 is handle recess 38 which is of a shape to mate with handle connecting flange 22 of handle 12. Rope 10 extends through a central opening 40 defined by ball bearing assembly 26. The rope is affixed to the ball bearing assembly by means of wire stop element 42 and/or washer stop element 44 which abut near surface 46 of ball bearing assembly 26.

Figure 3:
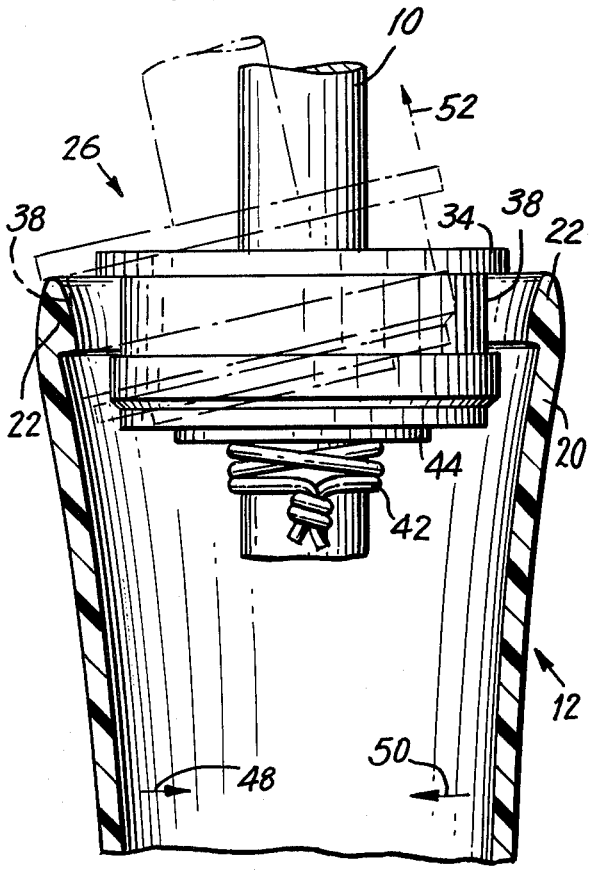

Since handle 2 is formed of a flexible, resilient material, detachment of the rope and ball bearing assembly from handle 12 is facilitated as shown in FIG. 3. Specifically, handle 12 is grasped by the thumb and forefinger of the user to be depressed in the direction depicted by arrows 48, 50. This motion tends to form open end 20 of handle 12 into an oval shape, whereby along one of the axes of the oval, handle connecting flange 22 is separated from its mating position with respect to its handle recess 38. In this manner, ball bearing assembly 26 is moved in the direction depicted by arrow 52 and thereby conveniently removed from handle 12. If it is necessary thereafter to remove rope 10 from ball bearing assembly 26, rope connecting means 42, 44 may be easily removed so that rope 10 is detached through ball bearing opening 40.

Just as easily, connection of ball bearing assembly 26 with rope 10 attached is accomplished. Handle 12 is grasped to move the handle in directions depicted by arrows 48, 50. The oval shape thereby caused at open end 20 of handle 12 enables resting of recess 38 upon connecting flange 22 of handle 12 at one end of the oval. At the other end of the oval, the ball bearing assembly is moved into position in a direction opposite to that depicted by arrow 52 so that the entire recess 38 may be fitted by handle connecting flange 22.

What is claimed is:

1. A jump rope construction comprising a one-piece hollow handle having an open end defining a handle connecting flange extending into the handle, a ball bearing assembly including balls, a race and a ball bearing housing including an outer flange and an inner shoulder defining therebetween a handle recess, said handle recess being constructed to mate with said handle connecting flange and said ball bearing assembly defining a ball bearing opening at its center for attachment of a rope therethrough, said handle being formed of a flexible resilient material to enable convenient detachment of said ball bearing assembly from said handle by compressing said handle at points proximate its open end thereby forming an oval configuration for said open end along one axis of which said handle recess is removed from said connecting flange.

* * * * *